US012473060B2

(12) United States Patent
Khachaturian

(10) Patent No.: US 12,473,060 B2
(45) **Date of Patent: *Nov. 18, 2025**

(54) MARINE LIFTING APPARATUS

(71) Applicant: VERSABAR, INC., Houston, TX (US)

(72) Inventor: Jon Khachaturian, New Orleans, LA (US)

(73) Assignee: GATORFUR, LLC, Houston, TX (US)

( * ) Notice: Subject to any disclaimer, the term of this patent is extended or adjusted under 35 U.S.C. 154(b) by 704 days.

This patent is subject to a terminal disclaimer.

(21) Appl. No.: 17/827,886

(22) Filed: May 30, 2022

(65) Prior Publication Data

US 2022/0363355 A1 Nov. 17, 2022

Related U.S. Application Data

(63) Continuation of application No. 16/752,016, filed on Jan. 24, 2020, now Pat. No. 11,345,452, which is a (Continued)

(51) Int. Cl.
*B63C 7/04* (2006.01)
*B63B 1/12* (2006.01)

(Continued)

(52) U.S. Cl.
CPC ..... *B63C 7/04* (2013.01); *B63B 1/121* (2013.01); *B63C 3/06* (2013.01); *B63C 7/16* (2013.01);

(Continued)

(58) Field of Classification Search
CPC ..... B63B 1/121; B63B 2001/123; B63B 1/14; B63B 27/10; B63B 27/16;

(Continued)

(56) References Cited

U.S. PATENT DOCUMENTS 42,651 A 5/1864 Tinkelpaugh
485,398 A * 11/1892 Tyler et al. ..... B63C 7/04 114/51

(Continued)

FOREIGN PATENT DOCUMENTS

| | | |
|---|---|---|
| JP | 58-122694 | 8/1983 |
| KR | 2010-0008652 | 1/2010 |
| WO | 99-13164 | 3/1999 |

OTHER PUBLICATIONS http://www.therangerstation.com/Magazine/summer2008/ujoints.htm, 2008.

*Primary Examiner* — Ajay Vasudeva
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A catamaran lifting apparatus is disclosed for lifting objects in a marine environment. The apparatus includes first and second vessels that are spaced apart during use. A first frame spans between the vessels. A second frame spans between the vessels. The frames are spaced apart and connected to the vessels in a configuration that spaces the vessels apart. The first frame connects to the first vessel with a universal joint and to the second vessel with a hinged connection. The second frame connects to the second vessel with a universal joint and to the first vessel with a hinged or pinned connection. Each of the frames extends upwardly in an inverted u-shape, providing a space under the frame and in between the barges that enables a marine vessel to be positioned in between the barges and under the frames.

26 Claims, 21 Drawing Sheets

Related U.S. Application Data continuation of application No. 15/936,264, filed on Mar. 26, 2018, now Pat. No. 10,543,890, which is a continuation of application No. 15/469,067, filed on Mar. 24, 2017, now Pat. No. 9,926,042, which is a continuation of application No. 14/667,028, filed on Mar. 24, 2015, now Pat. No. 9,604,710, which is a continuation of application No. 13/260,501, filed as application No. PCT/US2010/027309 on Mar. 15, 2010, now Pat. No. 8,985,040, which is a continuation of application No. 12/411,948, filed on Mar. 26, 2009, now abandoned, which is a continuation-in-part of application No. 11/610,271, filed on Dec. 13, 2006, now Pat. No. 7,527,006.

(60) Provisional application No. 60/743,917, filed on Mar. 29, 2006.

(51) Int. Cl.
*B63B 27/10* (2006.01)
*B63C 3/06* (2006.01)
*B63C 7/16* (2006.01)

(52) U.S. Cl.
CPC ..... *B63B 2001/123* (2013.01); *B63B 27/10* (2013.01)

(58) Field of Classification Search
CPC ..... B63B 2027/165; B63B 27/36; B63B 2738/00; B63B 2738/12; B63C 3/06; B63C 7/00; B63C 7/02; B63C 7/04; B63C 7/16; B63C 2205/08; B63C 2702/02
See application file for complete search history.

(56) References Cited

U.S. PATENT DOCUMENTS 541,794 A 6/1895 Schon
1,659,647 A 2/1928 Althouse
1,807,361 A 5/1931 Weinreich
1,822,418 A * 9/1931 Philip ..... B63B 1/14 114/61.15
2,390,654 A * 12/1945 Kittinger ..... B63C 7/04 114/51
2,916,002 A * 12/1959 Hunsucker ..... B63C 7/04 114/51
3,323,478 A * 6/1967 Hunsucker ..... B63B 1/14 114/265
3,645,405 A 2/1972 Stiglich
3,807,336 A 4/1974 Briggs
4,385,583 A 5/1983 Ayers
4,714,382 A 12/1987 Khachaturian
5,054,415 A 10/1991 Marshall
5,607,260 A * 3/1997 Khachaturian ..... B63B 77/00 405/209
5,609,441 A 3/1997 Khachaturian
5,662,434 A 9/1997 Khachaturian
5,800,093 A 9/1998 Khachaturian
5,836,463 A 11/1998 Khachaturian
5,863,085 A 1/1999 Khachaturian
5,975,807 A 11/1999 Khachaturian
6,000,562 A 12/1999 Khachaturian
6,039,506 A 3/2000 Khachaturian
6,079,760 A 6/2000 Khachaturian
6,149,350 A 11/2000 Khachaturian
6,213,319 B1 4/2001 Khachaturian
6,296,288 B1 10/2001 Khachaturian
6,318,931 B1 11/2001 Khachaturian
6,364,574 B1 4/2002 Khachaturian
6,367,399 B1 4/2002 Khachaturian
6,412,649 B1 7/2002 Khachaturian
6,425,710 B1 7/2002 Khachaturian
6,435,773 B1 8/2002 Khachaturian
6,435,774 B1 8/2002 Khachaturian
6,601,717 B1 8/2003 Khachaturian
6,692,190 B2 2/2004 Khachaturian
6,719,495 B2 4/2004 Khachaturian
7,066,343 B1 6/2006 Khachaturian
7,399,018 B1 7/2008 Khachaturian
7,527,006 B2 * 5/2009 Khachaturian ..... B63C 7/04 405/204
7,845,296 B1 12/2010 Khachaturian
7,886,676 B2 2/2011 Khachaturian
8,061,289 B2 11/2011 Khachaturian
8,240,264 B2 8/2012 Khachaturian
8,985,040 B2 3/2015 Khachaturian
9,003,988 B2 4/2015 Khachaturian
9,527,560 B2 12/2016 Khachaturian
9,604,710 B2 3/2017 Khachaturian
9,926,042 B2 3/2018 Khachaturian
10,543,890 B2 1/2020 Khachaturian
11,345,452 B2 * 5/2022 Khachaturian ..... B63C 3/06
2009/0301372 A1 12/2009 Khachaturian

* cited by examiner

MARINE LIFTING APPARATUS

CROSS-REFERENCE TO RELATED APPLICATIONS

This is a continuation of U.S. patent application Ser. No. 16/752,016, filed 24 Jan. 2020 (issued as U.S. Pat. No. 11,345,452 on 31 May 2022), which is a continuation of U.S. patent application Ser. No. 15/936,264, filed 26 Mar. 2018 (issued as U.S. Pat. No. 10,543,890 on 28 Jan. 2020), which is a continuation of U.S. patent application Ser. No. 15/469,067, filed 24 Mar. 2017 (issued as U.S. Pat. No. 9,926,042 on 27 Mar. 2018), which is a continuation of U.S. patent application Ser. No. 14/667,028, filed 24 Mar. 2015 (issued as U.S. Pat. No. 9,604,710 on 28 Mar. 2017), which is a continuation of U.S. patent application Ser. No. 13/260,501, filed 19 Dec. 2011 (issued as U.S. Pat. No. 8,985,040 on 24 Mar. 2015), which is a 35 U.S.C. § 371 national stage entry application of International Patent Application Serial No. PCT/US2010/027309, filed 15 Mar. 2010, which is a continuation of U.S. patent application Ser. No. 12/411,948, filed 26 Mar. 2009, which is a continuation-in-part of US patent application Ser. No. 11/610,271, filed 13 Dec. 2006 (issued as U.S. Pat. No. 7,527,006 on 5 May 2009), which claims benefit of U.S. Provisional Patent Application No. 60/743,917, filed 29 Mar. 2006, priority of each of which is hereby claimed.

U.S. patent application Ser. No. 12/411,948, filed 26 Mar. 2009 and U.S. patent application Ser. No. 11/610,271, filed 13 Dec. 2006, now U.S. Pat. No. 7,527,006, are both incorporated herein by reference.

Priority of U.S. patent application Ser. No. 12/411,948, filed 26 Mar. 2009, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to marine lifting devices. More particularly, the present invention relates to an improved catamaran type lifting apparatus that employs spaced apart or catamaran hulls, each of the hulls supporting a truss or frame that spans between the hulls at spaced apart positions. Even more particularly, the present invention relates to an improved catamaran lifting apparatus for use in a marine environment, wherein spaced apart frames are connected to the hulls in a configuration that spaces the vessels apart, the first frame connecting with a first of the hulls with the universal joint and to the second hull with a hinged connection, the second frame connecting to the second hull with a universal joint and to the first hull with a hinged connection.

2. General Background

A catamaran lifting apparatus that can be used to lift multi-ton objects employs two spaced apart barges or hulls or vessels. In general, such lifting devices that employ a pair of spaced apart hulls have been patented, many patents having been issued to applicant as contained in the following table.

TABLE 1

| PAT. NO. | TITLE | ISSUE DATE |
|---|---|---|
| 4,714,382 | Method and Apparatus for the Offshore Installation of Multi-Ton Prefabricated Deck Packages on Partially Submerged Offshore Jacket Foundations | Dec. 22, 1987 |
| 5,607,260 | Method and Apparatus for the Offshore Installation of Multi-Ton Prefabricated Deck Packages on Partially Submerged Offshore Jacket Foundations | Mar. 1, 1997 |
| 5,609,441 | Method and Apparatus for the Offshore Installation of Multi-Ton Prefabricated Deck Packages on Partially Submerged Offshore Jacket Foundations | Mar. 11, 1997 |
| 5,662,434 | Method and Apparatus for the Offshore Installation of Multi-Ton Prefabricated Deck Packages on Partially Submerged Offshore Jacket Foundations | Sep. 2, 1997 |
| 5,800,093 | Method and Apparatus for the Offshore Installation of Multi-Ton Packages Such as Deck Packages, Jackets, and Sunken Vessels | Sep. 1, 1998 |
| 5,975,807 | Method and Apparatus for the Offshore Installation of Multi-Ton Packages Such as Deck Packages and Jackets | Nov. 2, 1999 |
| 6,039,506 | Method and Apparatus for the Offshore Installation of Multi-Ton Packages Such as Deck Packages and Jackets | Mar. 21, 2000 |
| 6,149,350 | Method and Apparatus for the Offshore Installation of Multi-Ton Packages Such as Deck Packages and Jackets | Nov. 21, 2000 |
| 6,318,931 | Method and Apparatus for the Offshore Installation of Multi-Ton Packages Such as Deck Packages and Jackets | Nov. 20, 2001 |
| 6,364,574 | Method and Apparatus for the Offshore Installation of Multi-Ton Packages Such as Deck Packages and Jackets | Apr. 2, 2002 |

BRIEF SUMMARY OF THE INVENTION

The present invention provides an improved catamaran lifting apparatus that employs first and second spaced apart vessels or hulls. The vessels can be barges, dynamically positioned marine vessels, other floating hulls or the like.

A first frame or truss spans between the vessels or hulls at a first position. A second frame or truss spans between the hulls at a second position. The first and second positions are spaced apart so that each frame can move independently of the other, notwithstanding wave action acting upon the hulls. Load spreaders can provide an interface between each frame or truss and each vessel (e.g. barge, ship, etc.)

The first of the frames or trusses connects to the first hull or vessel with a universal joint and to the second hull or vessel with a hinged connection. The second frame connects to the second hull with a universal joint and to the first hull with a hinged connection.

The catamaran hull arrangement of the present invention provides longitudinal flexibility in a quartering sea state due to the unique universal joint and hinge placement between the frames or trusses and the hulls or vessels.

Each frame extends upwardly in a generally inverted u-shape that provides space under each frame or truss and in between the vessels or hulls for enabling a marine vessel to be positioned in between the hulls and under the frames. The space in between the hulls or vessels and under the frames or trusses can also be used as clearance for elevating an object to be salvaged from the seabed to a position next to or above the water's surface.

In a plan view, each frame or truss can be generally triangular in shape. Winches and rigging such as a block and tackle arrangement can be used to lift objects with the apparatus of the present invention. The frames can each be of a truss configuration.

In a second embodiment, one or more slings can be provided that connect between a frame and a hull. The connection of each frame to a hull opposite the universal joint can be a pinned or a hinged connection.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 9A-9D are fragmentary views of the preferred embodiment of the apparatus of the present invention, wherein FIG. 9B is a sectional, top view taken along lines 9B-9B of FIG. 9A, FIG. 9C is an elevation view taken along lines 9C-9C of FIG. 9A, and FIG. 9D is a sectional view taken along lines 9D-9D of FIG. 9C;

DETAILED DESCRIPTION OF THE INVENTION

Figure 1:
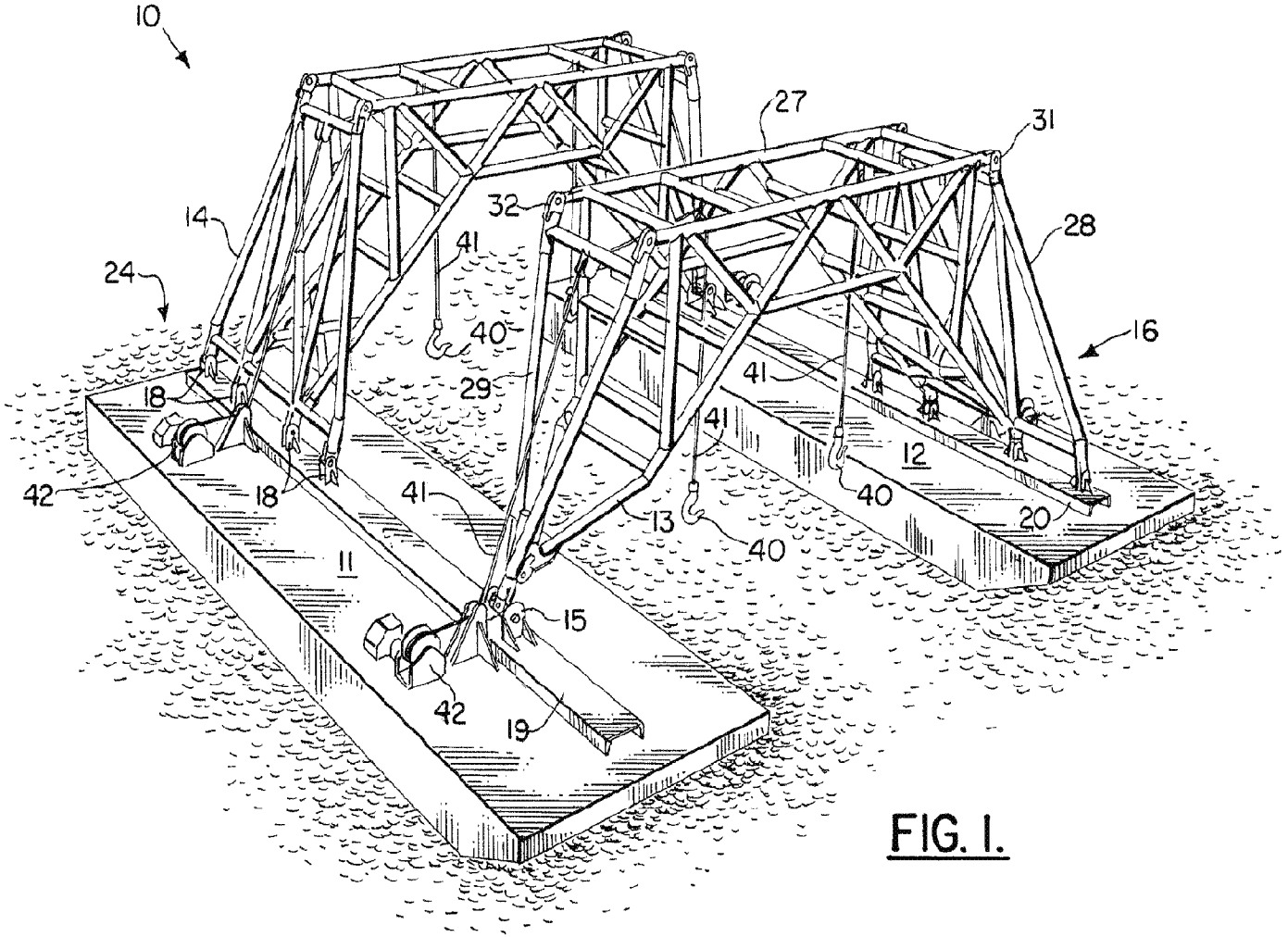
FIG. 1 is a perspective view of the preferred embodiment of the apparatus of the present invention.
Figure 2:
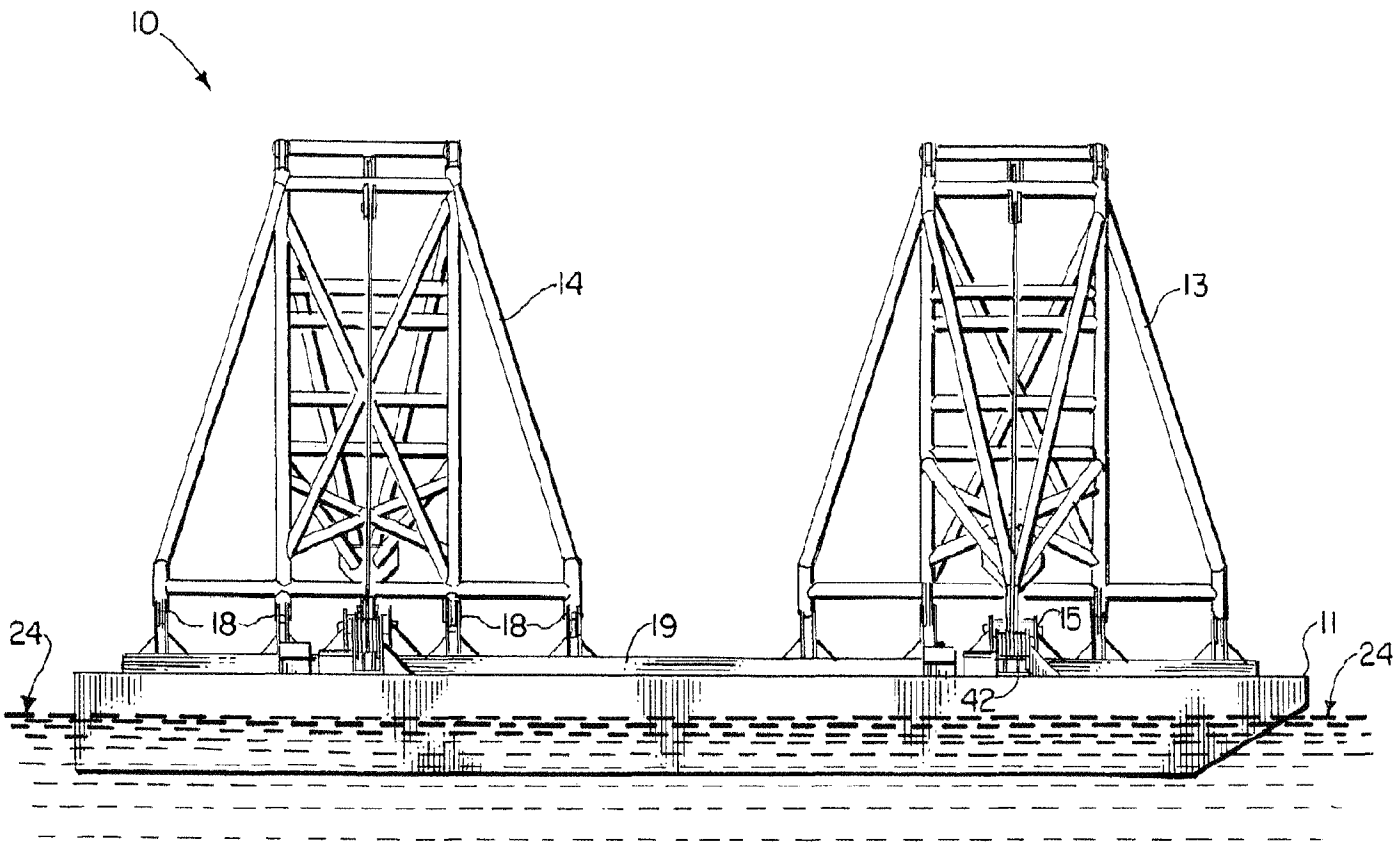
FIG. 2 is a side, elevation view of the preferred embodiment of the apparatus of the present invention.

FIGS. 1-7 and 9-11 show the preferred embodiment of the apparatus of the present invention designated generally by the numeral 10. Marine lifting apparatus 10 provides a pair of spaced apart vessels or hulls 11, 12, each providing a deck 30. Hulls 11, 12 can be barges, dynamically positioned vessels, or any other buoyant structure. A pair of frames or trusses 13, 14 are provided, each frame 13, 14 spanning between the vessels 11, 12. Each frame 13, 14 connects to one vessel 11 or 12 with a universal joint 15 or 17 (see FIGS. 1, 4, 9) and to the other hull 11 or 12 with a hinged or pinned connection 16 or 18 (see FIGS. 4-12).

The first frame 13 connects to hull 11 with universal joint 15 (or articulating connection). The first frame 13 connects to vessel 12 with a pinned connection or hinge 16. Similarly, the second frame 14 connects to hull 12 with a universal joint 17 (or articulating connection) and to hull 11 with a hinge or pinned connection 18 (see FIG. 4).

An interface such as a deck beam or load spreader platform 19 or 20 can be provided on the upper deck 30 of each hull 11, 12 for forming an interface between the frames 13, 14 and the vessels 11, 12. For example, vessel 11 is provided with deck beam or load spreader platform 19 on its deck 30 that forms an interface between each of the frames 13, 14 and the barge or vessel 11 deck 30. Deck beam or load spreader platform 20 provides an interface between each of the frames 13, 14 and deck 30 of the vessel or barge 12.

Figure 4:
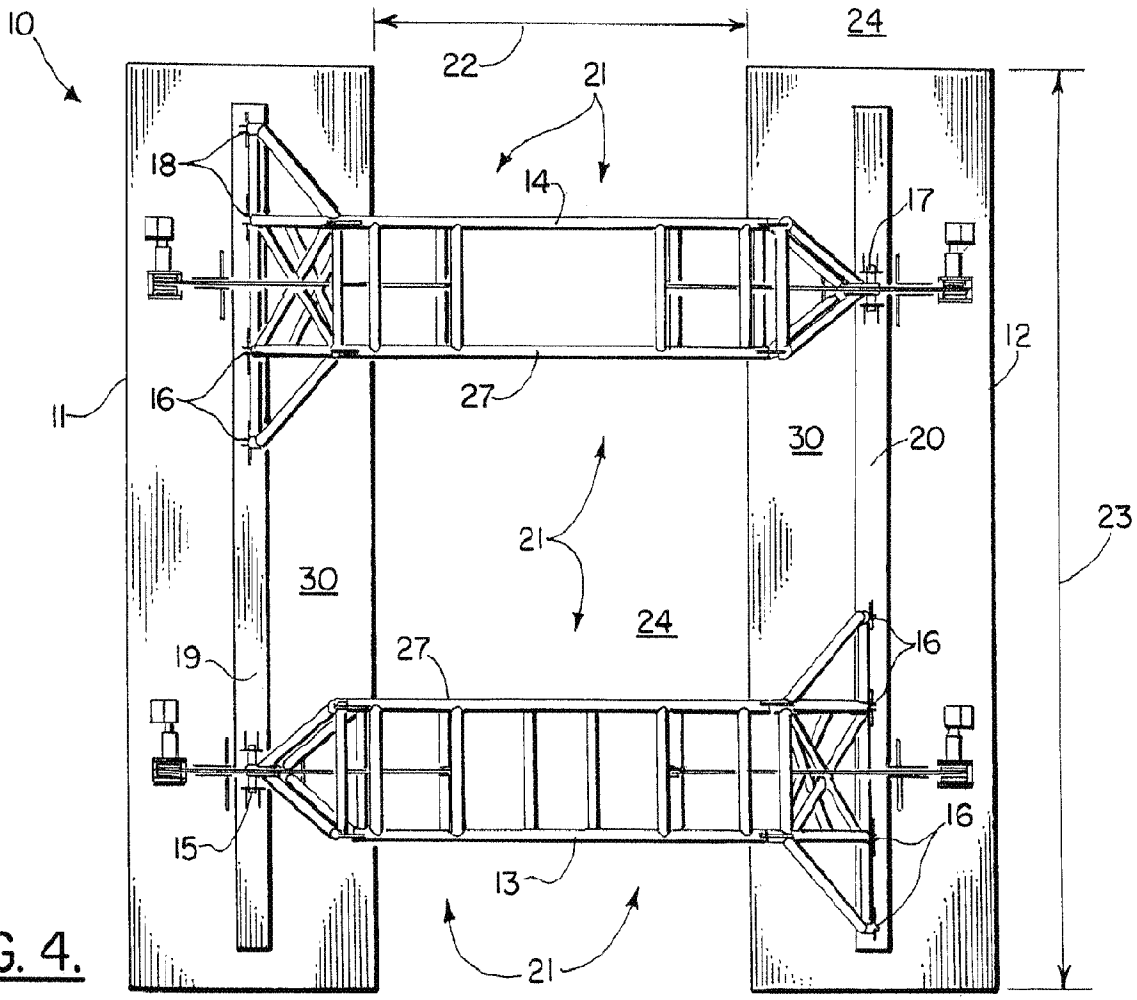
FIG. 4 is a top plan view of the preferred embodiment of the apparatus of the present invention.
Figure 5:
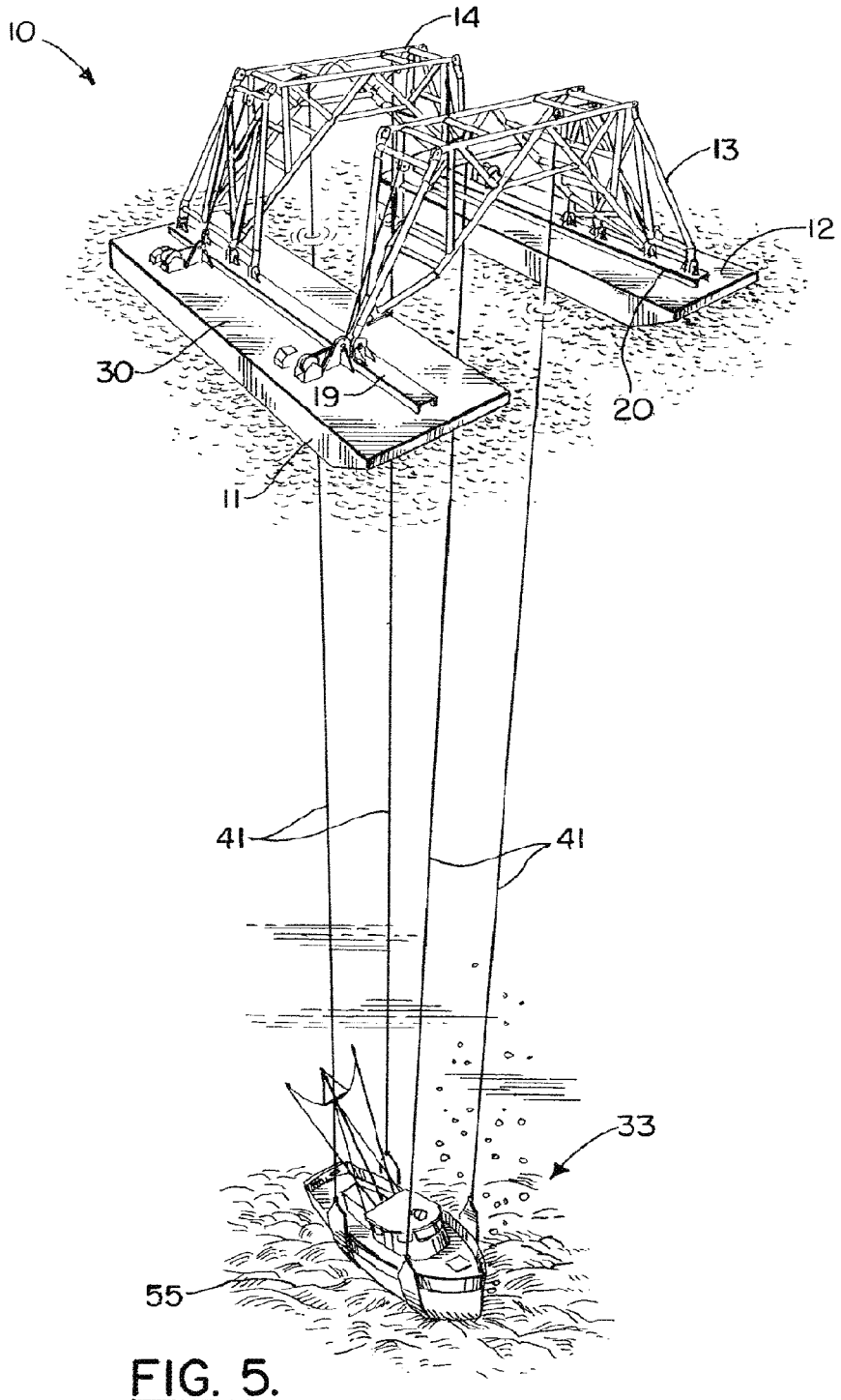
FIG. 5 is a perspective view of the preferred embodiment of the apparatus of the present invention.

In FIG. 4, a plan or top view of the apparatus 10 of the present invention is shown. A lifting area 21 is that area that is in between the vessels 11, 12, the area 21 having a length defined by dimension arrow 23 and a width defined by dimension arrow 22 in FIG. 4. This area 21 is sized and shaped to receive a vessel having a cargo to be lifted if that cargo (e.g. deck package) is to be installed. Alternatively, the area 21 can be an area that receives a vessel for supporting and transporting an item to be salvaged from an ocean floor (see FIGS. 5 and 11-15) such as a hurricane smashed or damaged offshore platform section 34, sunken boat 33 or the like. In either case, a clearance is provided above the water surface 24.

Figure 3:
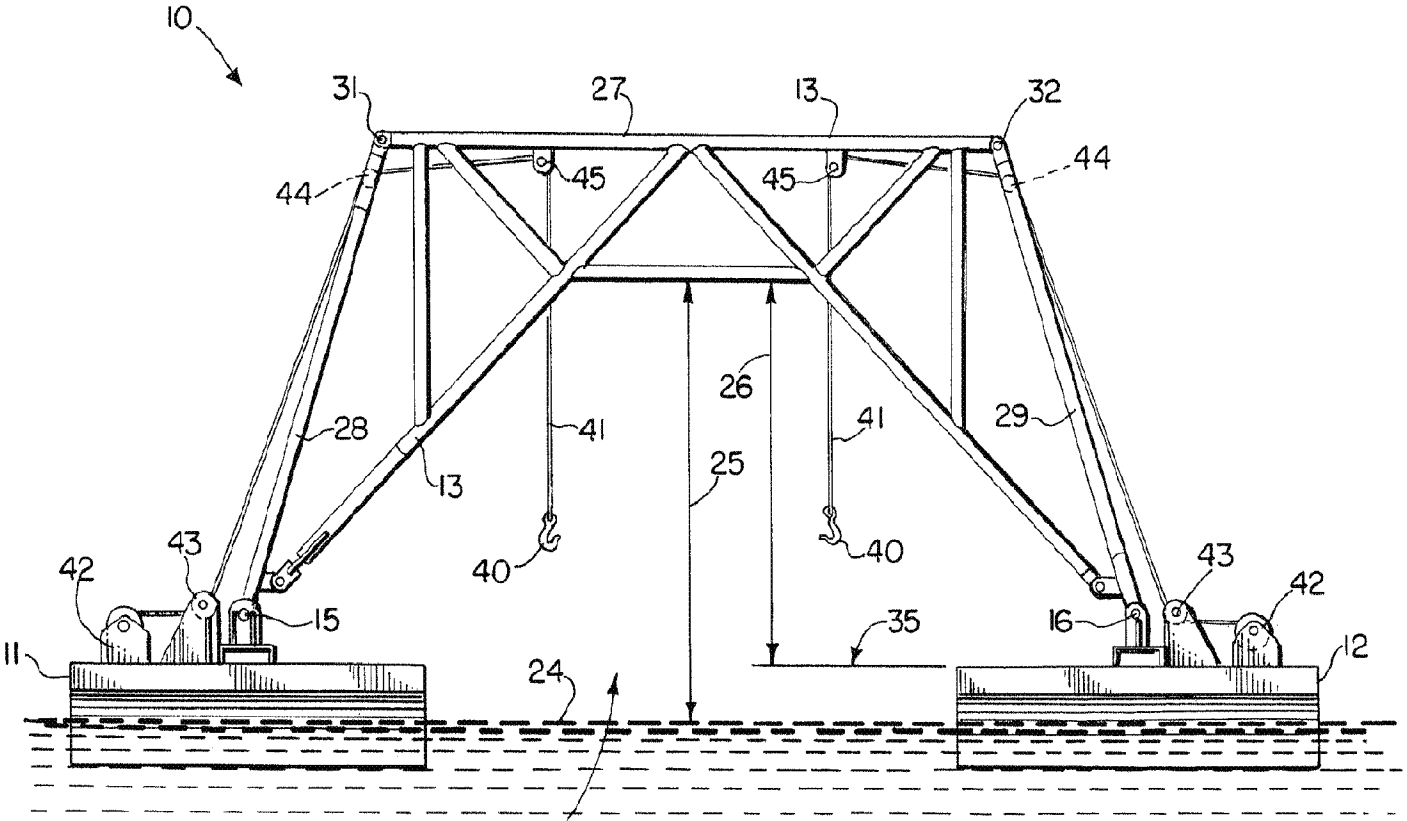
FIG. 3 is an end elevation view of the preferred embodiment of the apparatus of the present invention, with each winch and lifting line removed for clarity.

In FIG. 3, a clearance between water surface 24 and frame 13 or 14 is indicated schematically by the dimension line 25. Similarly, a clearance 26 is provided above the maximum deck elevation 35 of the hulls 11, 12 as shown in FIG. 3.

Each of the frames 13, 14 can be in the form of a truss as shown. The frames are generally speaking in the shape of an arch or inverted U so that an area is provided under the frames and above the water surface for raising an item that is being salvaged or to lift an item from a barge or other vessel or support that is under the frames. Each truss or frame 13, 14 can be a one piece structure (see FIG. 10) or a multi-section truss (see FIGS. 1-4). For multi-section frames 13, 14 they provide a center truss section 27, a smaller side truss section 28 and another smaller side truss section 29. Pinned connections 31, 32 can be provided for attaching the smaller truss sections 28, 29 to the larger center truss section 27 as shown in FIGS. 3 and 4.

Slings can optionally be provided for connecting the center section 27 to the lower end portion of each of the smaller truss sections 28, 29. Shackles can be used to attach each of the slings to eyelets or padeyes on the center section 27. Likewise, shackles can be used to attach the slings to eyelets or padeyes on the smaller truss sections 28, 29.

Figure 13:
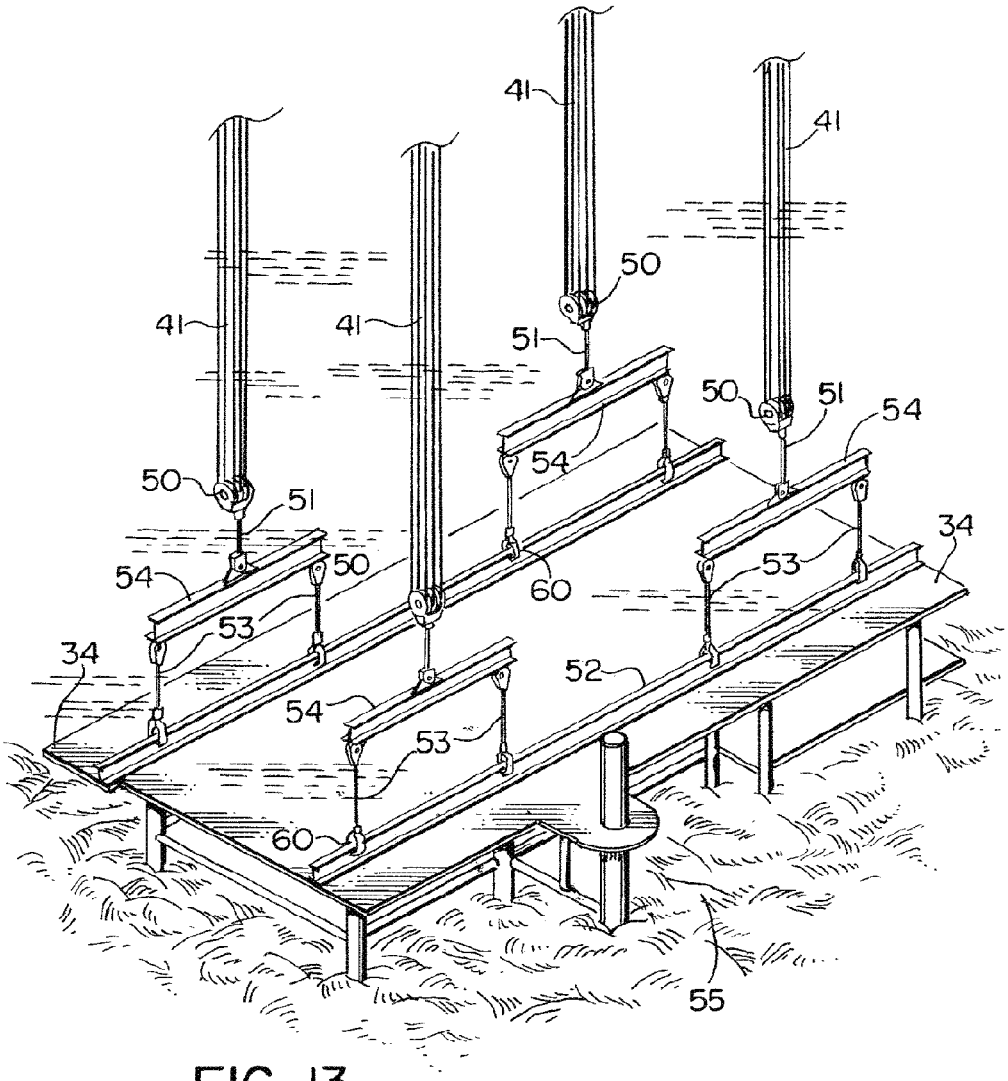
FIG. 13 is a partial perspective view of the preferred embodiment of the apparatus of the present invention and showing a method step of the present invention.

A hook 40 or other lifting fitting can be attached to a lifting line 41 and payed out from winch 42. More than one lifting line 41 and hook 40 can be provided as shown. Sheaves 43, 44, 45 as needed can be used to route the line 41 from winch 42 to hook 40. Line 41 can be a multiple line assembly to increase lift capacity such as is shown in FIG. 13. Hook 40 can be any lifting fitting such as any known commercially available crown block, for example.

Figure 6:
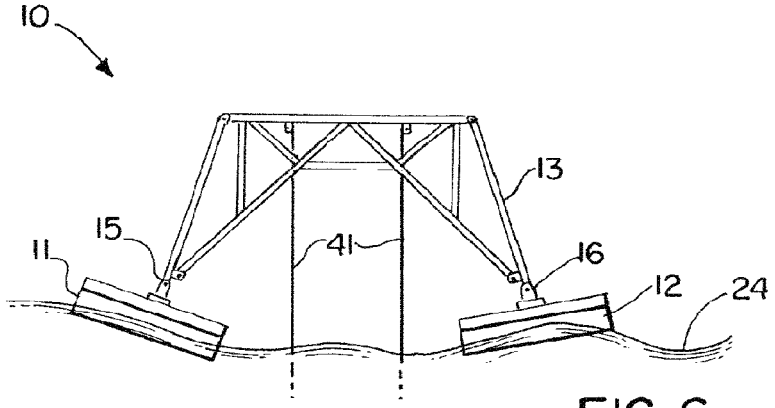
FIGS. 6-8 are schematic illustrations of a rough sea condition.
Figure 7:
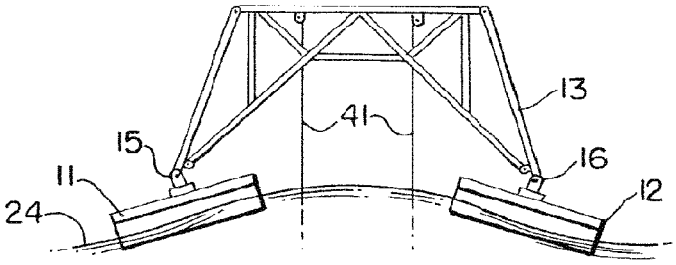
Figure 8:
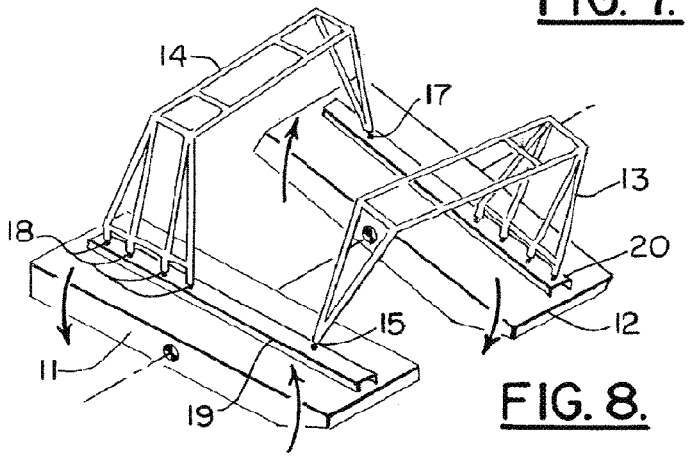
Figure 9A:
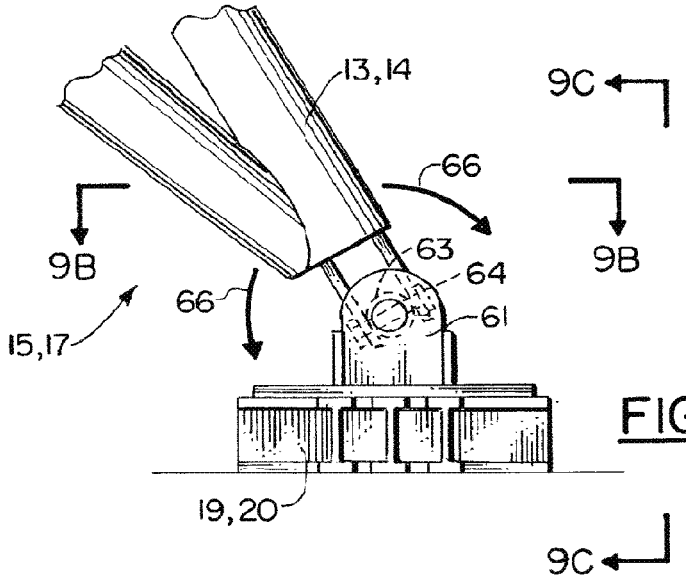
Figure 9B:
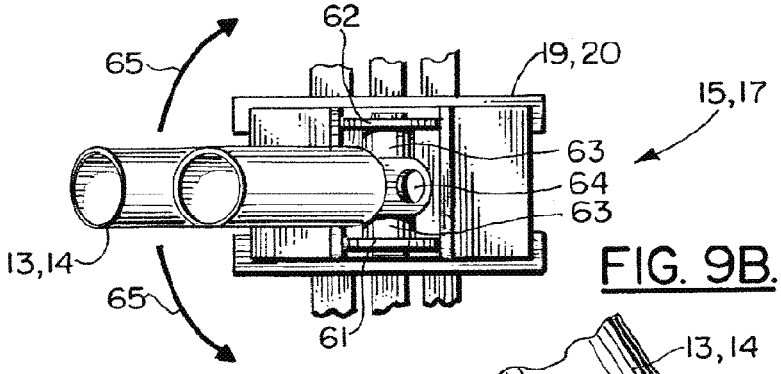
Figure 9C:
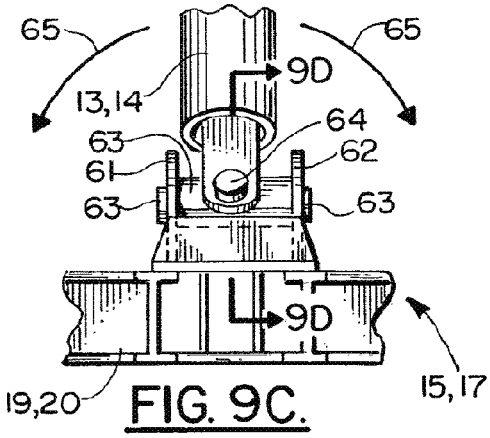
Figure 9D:
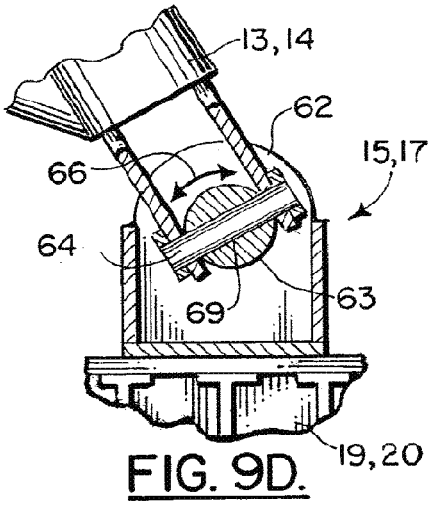

FIGS. 6-9 illustrate the articulation that is achieved with the method and apparatus of the present invention, even in rough seas. In FIGS. 6 and 7, rough sea conditions are shown wherein the vessels 11, 12 assume differing orientations relative to each other caused by the rough sea state. Notwithstanding the orientation of the vessels 11, 12 the combination of an articulating connection 15, 17 with hinged or pinned connections 16, 18 enables complete articulation between each of the frames or trusses 13, 14 and each of the vessels or hulls 11, 12.

In FIGS. 9A-9D, an exemplary articulating connection 15, 17 is shown. In FIGS. 9A-9D, a frame or truss 13, 14 connects to a load spreader platform 19 or 20 at padeyes 61, 62. A first shaft 63 is pivotally attached to the padeyes 61, 62. A second shaft 64 is pivotally attached to the first shaft 63 at opening 69 in first shaft 63. The second shaft 64 also defines a pivotal connection for the frame 13 or 14 to the first shaft 63 as shown. This universal joint arrangement enables the frame 13 (or 14) to move in an articulating fashion with respect to the load spreader platform 19 or 20 and with respect to the underlying vessel 11 or 12 as indicated schematically by arrows 65, 66 in FIGS. 9A-9D.

FIGS. 10-17 show the preferred embodiment of the apparatus of the present invention when fitted with a block and tackle arrangement. Vessels 11, 12 are also shown fitted with anchor lines 67 that connect conventional anchors (not shown) to anchor winches 68 on the vessels 11, 12. The anchor winches 68 can be used to exactly position vessels 11, 12 and to stabilize their positions during a lift. A block and tackle arrangement (FIGS. 10-17) can be used to lift an item to be salvaged from the seabed 55 such as the damaged platform section 34 in FIG. 12.

Figure 10:
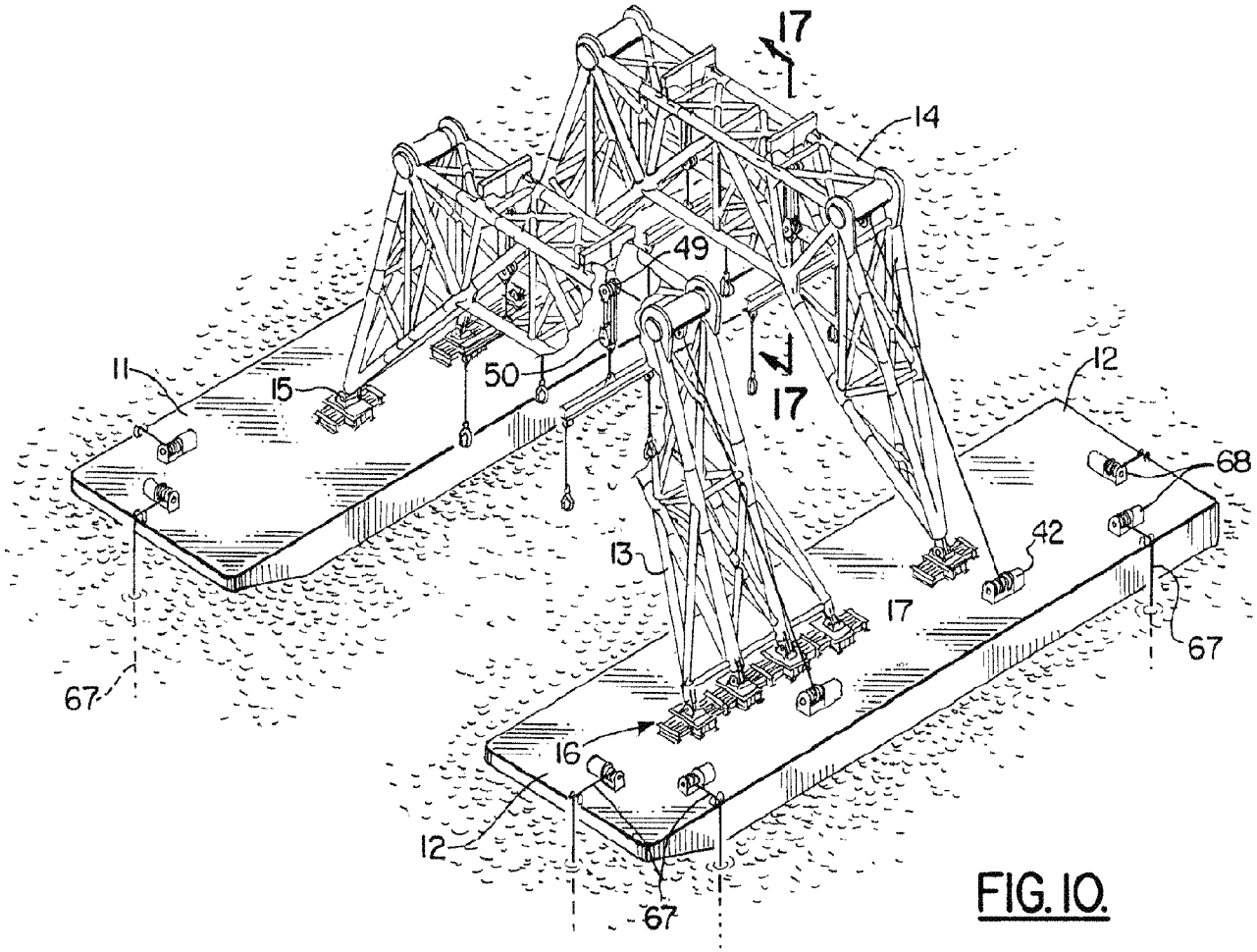
FIG. 10 is a perspective view of the preferred embodiment of the apparatus of the present invention showing a block and tackle rigging with winches and lift lines.
Figure 11:
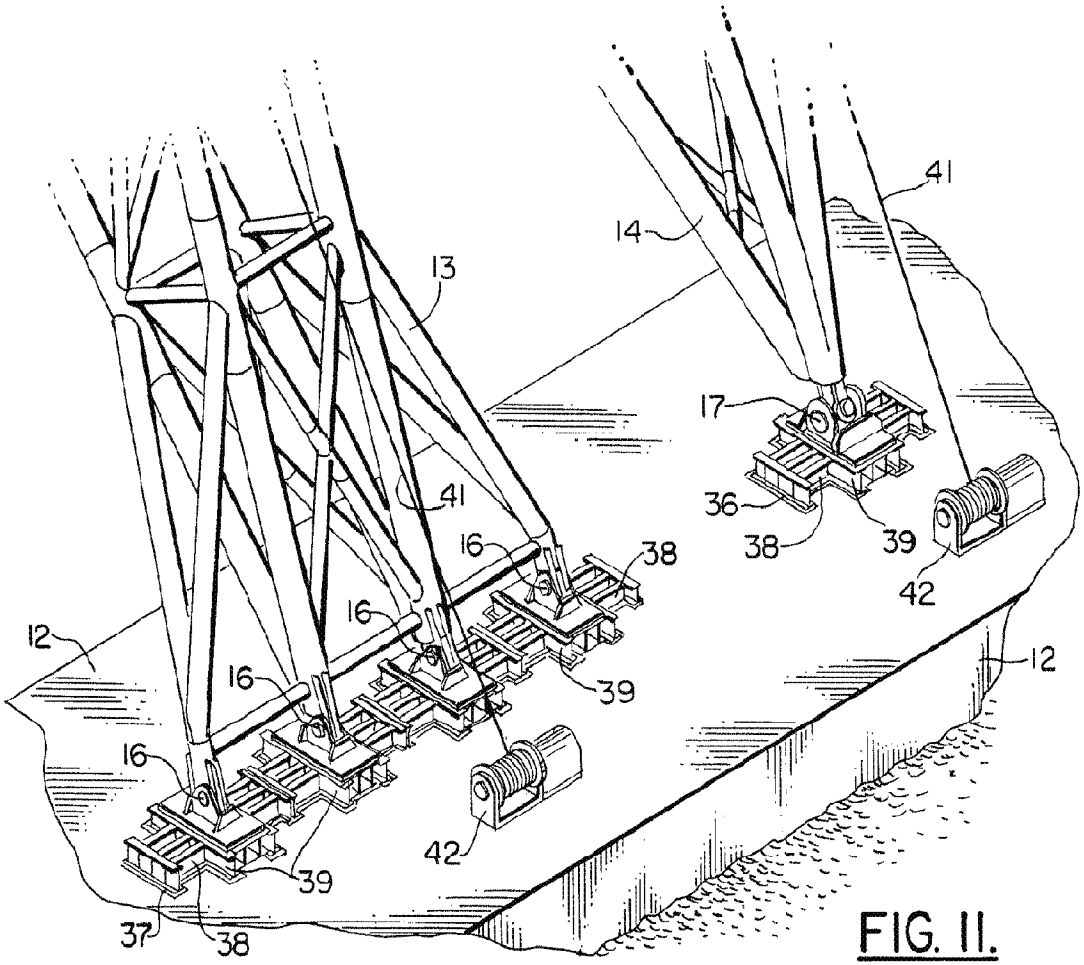
FIG. 11 is a fragmentary perspective view of the preferred embodiment of the apparatus of the present invention.
Figure 12:
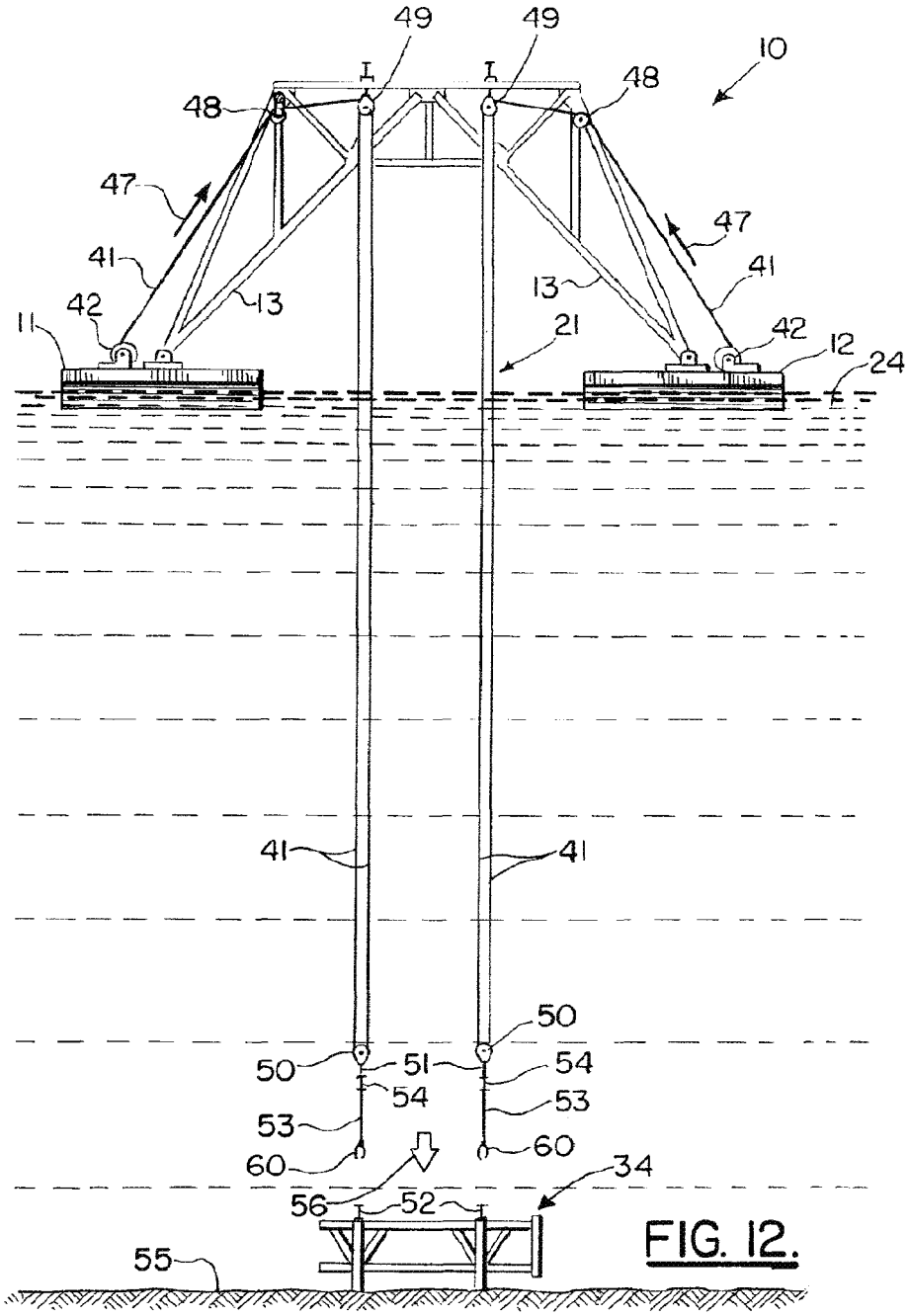
FIG. 12 is an elevation view of the preferred embodiment of the apparatus of the present invention and showing a method step of the present invention.
Figure 15:
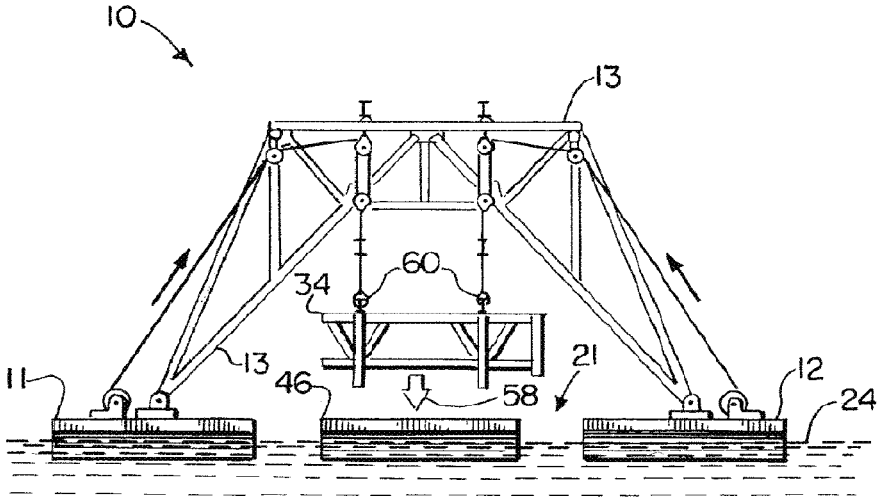
FIGS. 15-16 are elevation views that further illustrate the method of the present invention.
Figure 16:
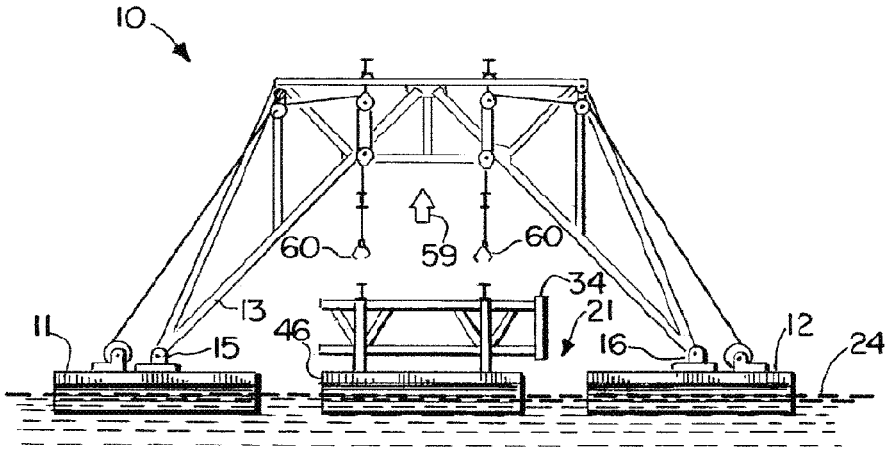
Figure 17:
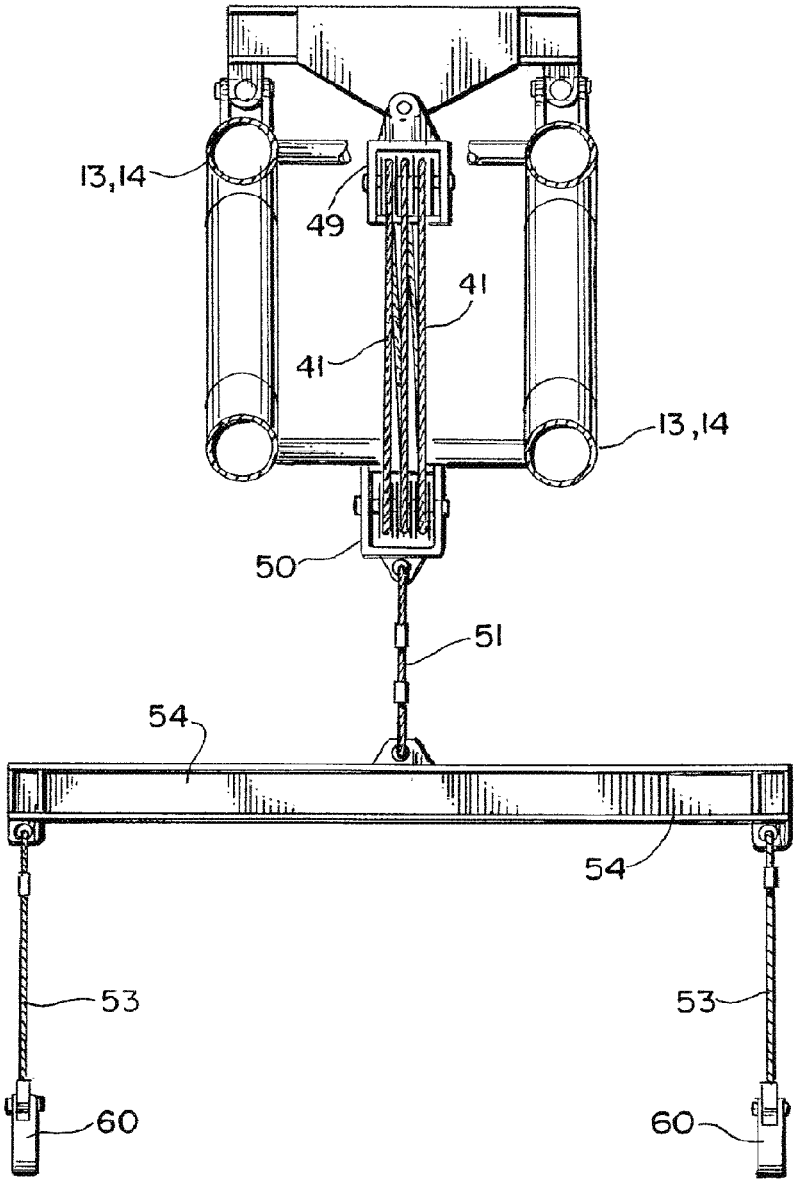
FIG. 17 is a sectional view taken along lines 17-17 of FIG. 10.

In FIGS. 10-17, each of the frames 13, 14 is rigged with an upper sheave 48 and upper pulley block 49. Each frame 13 or 14 can be rigged with a lifting line 41 and one or more winches 42. In FIGS. 10-12 for example, each frame 13, 14 has two winches 42, each winch 42 having a lifting line or cable 41. Lower pulley block 50 is positioned below upper pulley block 49. The pulley blocks 49, 50 can pro vide multiple pulleys such as is shown in FIGS. 10, 13 and 17. Slings 51 can be rigged to each lower pulley block 50. Each sling 51 can support a lifting beam or spreader bar 54. Each spreader bar 54 can support one or more slings 53 as shown in FIGS. 12, 17. The slings 53 can be provided with any selected additional rigging such as clamps, shackles or grabs 60, as examples. Arrows 47 in FIG. 12 show lines 41 being payed out to lower the lower pulley blocks 50 to damaged platform section 34 (see arrow 56, FIG. 12).

Figure 14:
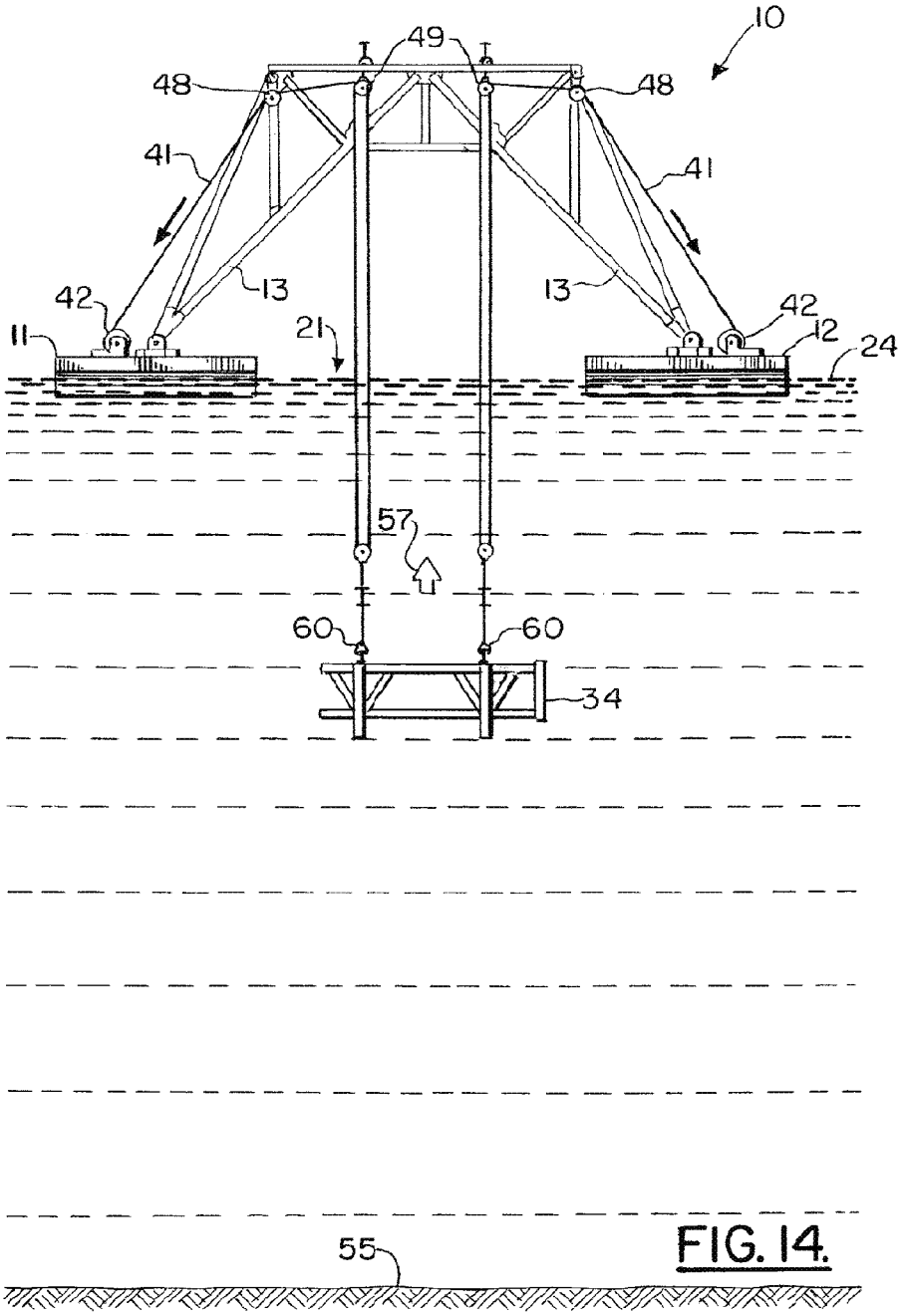
FIG. 14 is an elevation view of the preferred embodiment of the apparatus of the present invention and illustrating the method of the present invention.

The damaged platform section 34 to be salvaged can be fitted with beams 52 such as I-beams as an example. As the damaged or sunken platform section 34 rests upon seabed 55, grabs 60 can be attached to the beams 52 with slings 53 as shown in FIG. 12 for a lifting operation. Arrow 56 in FIG. 12 schematically illustrates a lowering of the lower pulley blocks 50 to the sunken, damaged platform section 34. After the grabs 60 are connected to the beams 52, arrow 57 in FIG. 14 schematically illustrates an elevating of the platform section 34 as each line 41 is wound upon its winch 42.

In FIG. 15, the transport vessel 46 is moved into the area 21 under frames 13, 14. Arrow 58 schematically illustrates a lowering of the damaged platform section 34 to the vessel 46. In FIG. 16, grabs 60 have been released from beams 52 and lifted upwardly in the direction of arrow 59, away from the damaged platform section 34. The damaged or salvaged item such as a vessel 33 or damaged platform section 34 can then be transported to a selected locale using the transport vessel or transport barge 46.

In FIG. 11, an alternate load spreader platform construction is shown. A smaller load spreader platform 36 is placed under each universal joint 15 or 17 of the frame 13 or 14. A larger load spreader platform 37 is placed under each pinned connection or hinge 16 or 18 of the frame 13 or 14. Each platform 36, 37 can comprise a plurality of longitudinal beams 38 and a plurality of transverse beams 39 as shown. The beams 38, 39 can be structurally connected together (e.g. welded together).

Figure 20:
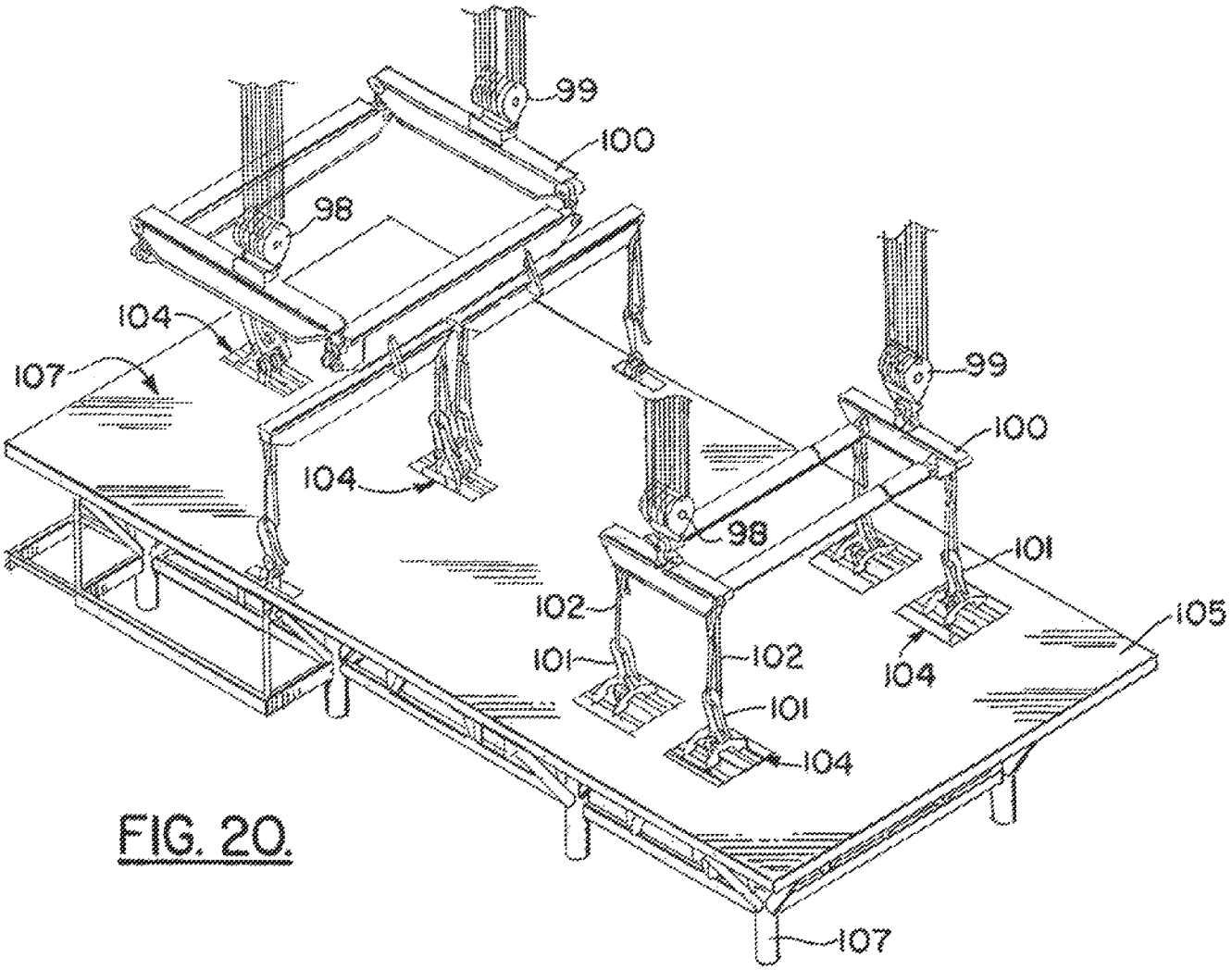
FIG. 20 is a fragmentary, perspective view of the second embodiment of the apparatus of the present invention.
Figure 21:
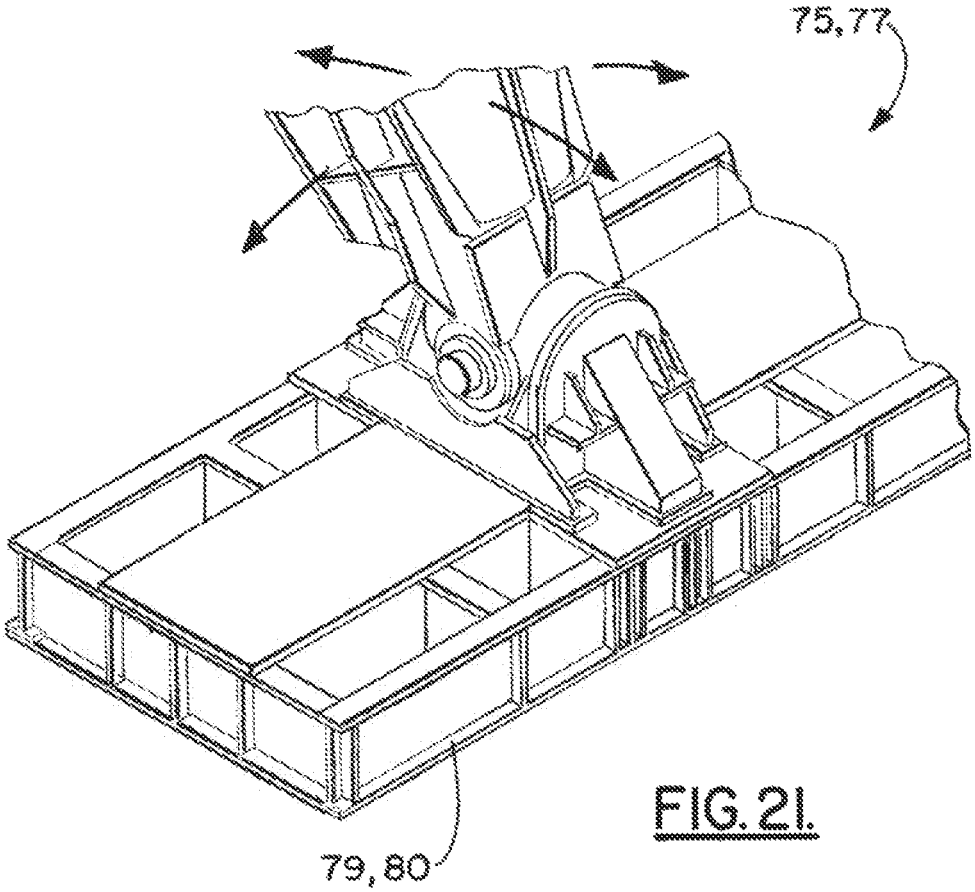
FIG. 21 is a partial, perspective view of the second embodiment of the apparatus of the present invention.

FIGS. 18-24 show a second embodiment of the apparatus of the present invention designated generally by the numeral 70. As with the preferred embodiment of FIGS. 1-17, the second embodiment of FIGS. 18-24 provides a marine lifting apparatus 70 that employs two vessels or hulls 71, 72. The vessels or hulls 71, 72 support a pair of frames 73, 74. Each frame 73, 74 is attached to each of the vessels 71, 72 using a universal joint and a hinge. The frame 73 attaches to the vessel 71 using universal joint 75 and to vessel 72 using hinge 76. Similarly, the frame 74 attaches to vessels 71 using hinge 78 and to vessel 72 using universal joint 77. The universal joint 75 of the frame 73 and the universal joint of the frame 74 are on different vessels as shown. Each of the frames 73, 74 interfaces with the vessels 71, 72 via universal joints and hinges and optionally with a load spreader platform interface 79, 80. FIG. 21 shows more particularly a load spreader platform interface 79, 80 and a universal joint 75, 77.

Figure 18:
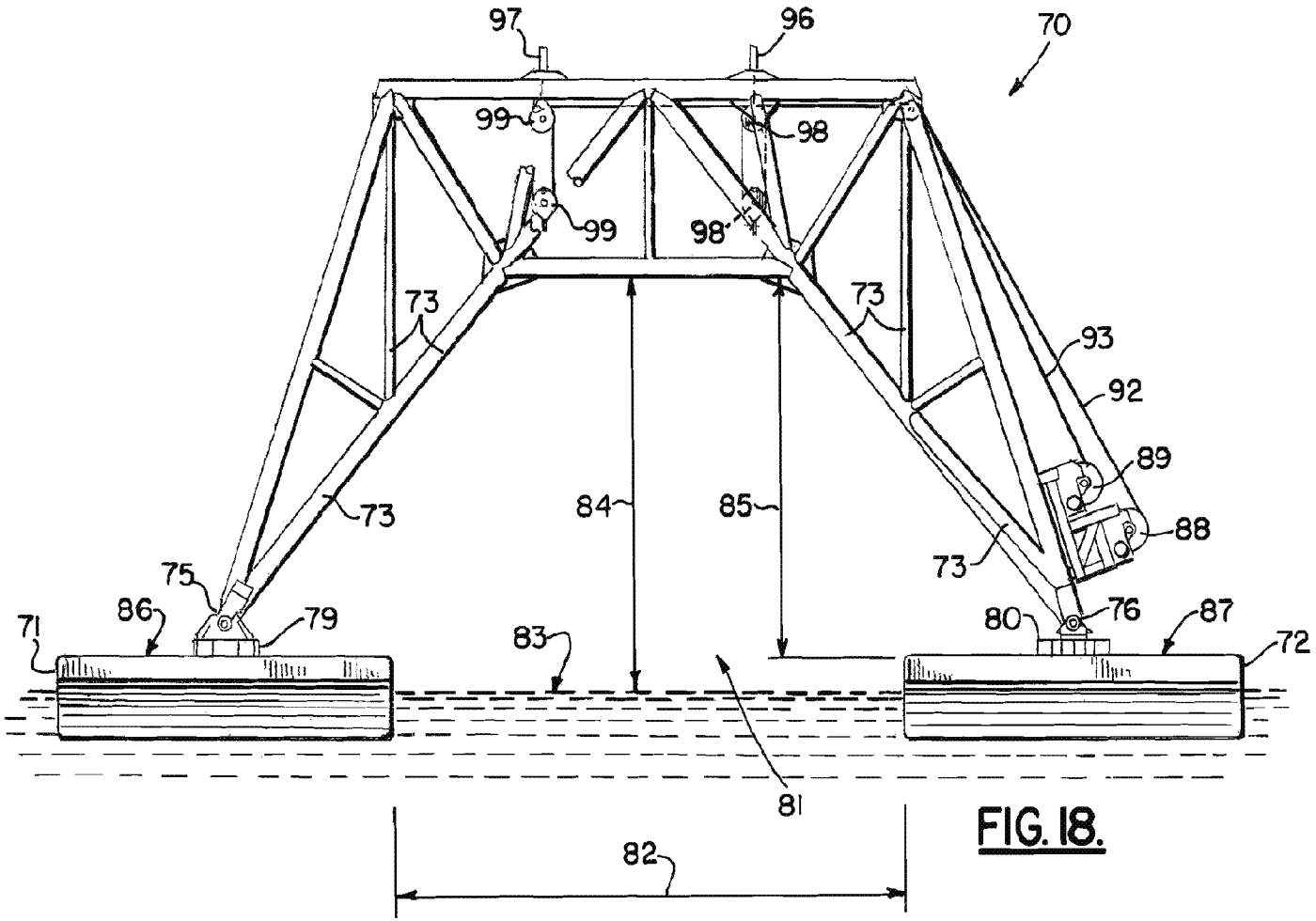
FIG. 18 is a elevation view of a second embodiment of the apparatus of the present invention.
Figure 19:
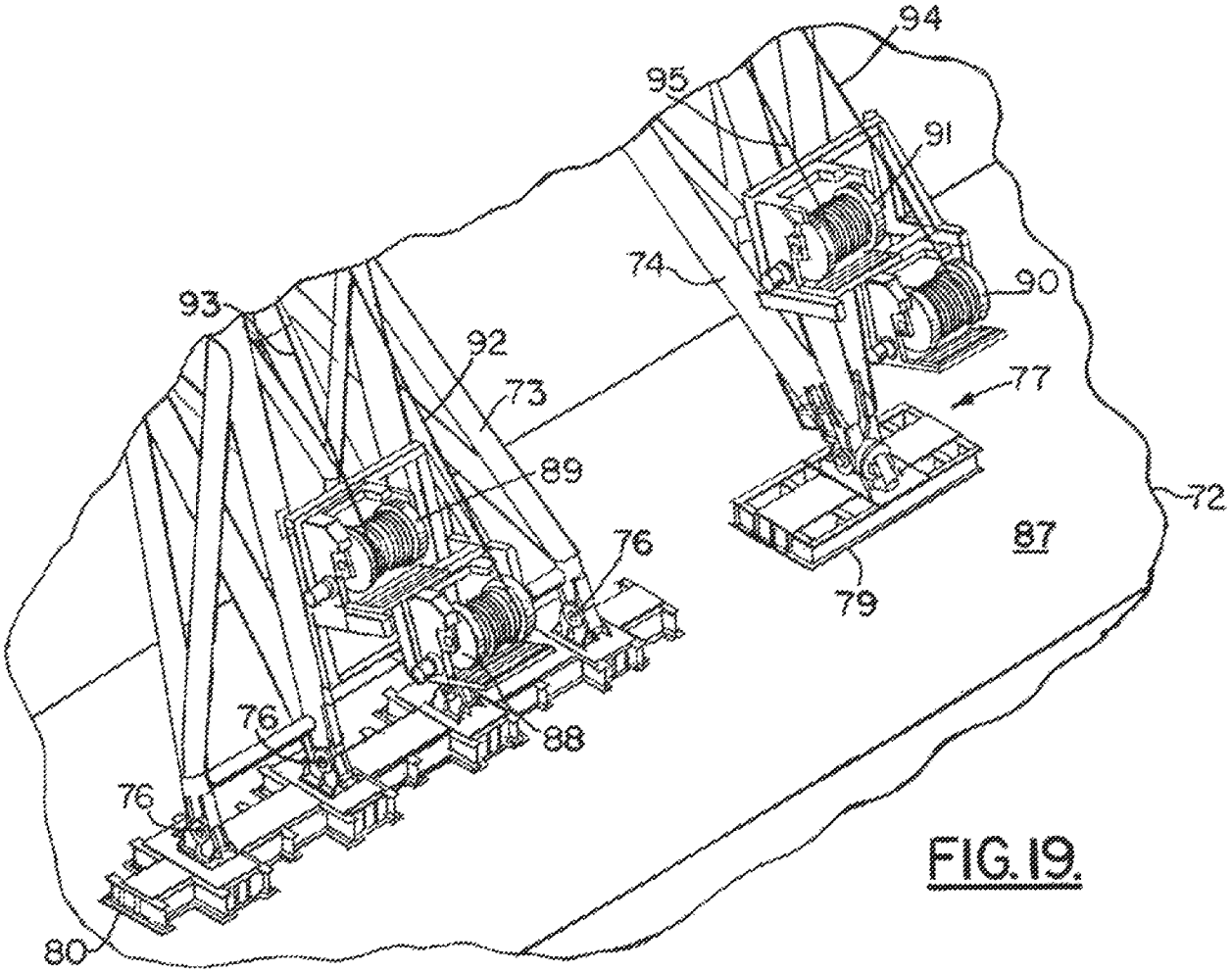
FIG. 19 is a plan fragmentary view of the second embodiment of the apparatus of the present invention.

An area 81 is provided in between each of the vessels 71, 72 as shown in FIG. 18 and under each of the frames 73, 74. In FIG. 18, dimension line 84 indicates the clearance between water surface 83 and each frame 73 or 74. The dimension line 85 indicates the clearance above the hull deck 86 or 87 of vessel 71 or 72 as shown. The dimension line 82 can be the width of the area 81 in between the barges or vessels 71, 72, indicated by the dimension line in FIG. 18 that is labeled with reference numeral 82.

A plurality of winches 88-91 are provided, two (2) winches 88, 89 or 90, 91 for each frame 73, 74. Each of the winches 88-91 provides a winch line that enables the winch to lift objects from a seabed or from the water surface area 83 via a crown block or block and tackle arrangement as shown in the drawings. The winch 88 provides a winch line 92. The winch 89 provides a winch line 93. The winches 88, 89 are mounted upon frame 73 as shown in FIG. 18. The winches 90, 91 are mounted upon the frame 74 as shown in FIG. 20. Winch 90 provides winch line 94. Winch 91 provides winch line 95.

Each frame 73, 74 is preferably in the form of a truss. In FIG. 18, each frame 73, 74 provides a pair of spaced apart beams 96, 97 that are used to support a crown block 98 or 99 or other lifting arrangement such a block or tackle or the like.

In the embodiment of FIGS. 18-24, there is provided for example two winches 88, 89 or 90, 91 for each frame 73 or 74. Each winch 88-91 is rigged to one of the beams 96, 97 using sheaves or other rigging. Each beam 96, 97 supports a crown block 98, 99, block and tackle or other lifting arrangement that affords mechanical advantage when the winches 88-91 are wound in a selected direction for either paying out or reeling in the respective winch lines 92-95.

An example of an underwater object to be salvaged is shown in FIG. 20 in the form of a platform 107. In FIG. 20, a plurality of crown blocks 98, 99 attach to a lifting frame or frames or spreaders 100. Each of the lifting frames or spreaders 100 is used to lift deck 107 using a plurality of hooks 101 and slings 102, 103. Each of the slings 102 is a sling that extends in between a lifting frame 100 and a hook 101.

With the method of the present invention, openings 104 can be cut in deck 105 of platform 107. In this fashion, slings 103 can extend downwardly from hooks 101 to underdeck beams 106 that are shown in phantom lines in FIG. 22.

Figure 22:
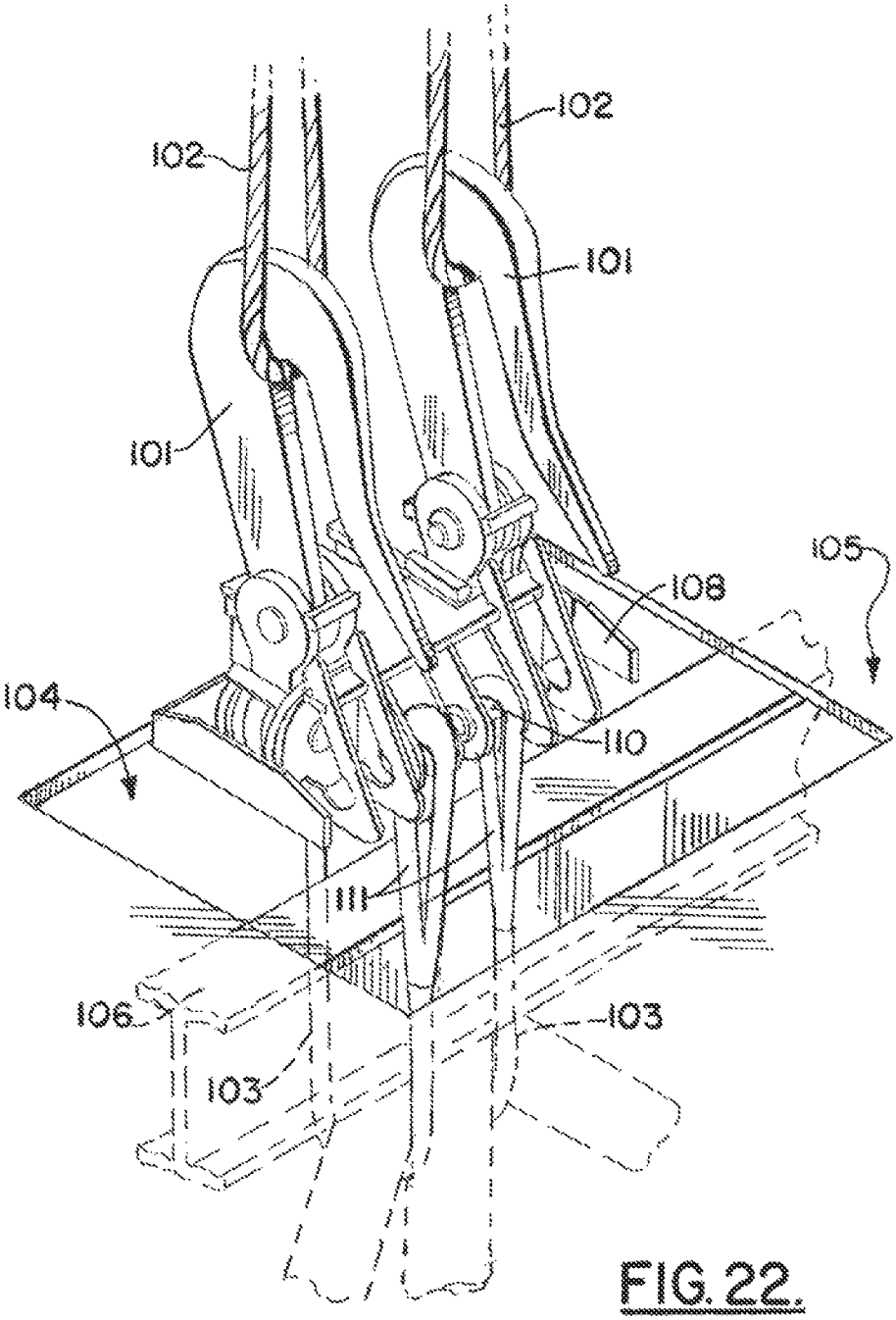
FIG. 22 is a partial, perspective view of the second embodiment of the apparatus of the present invention.
Figure 23:
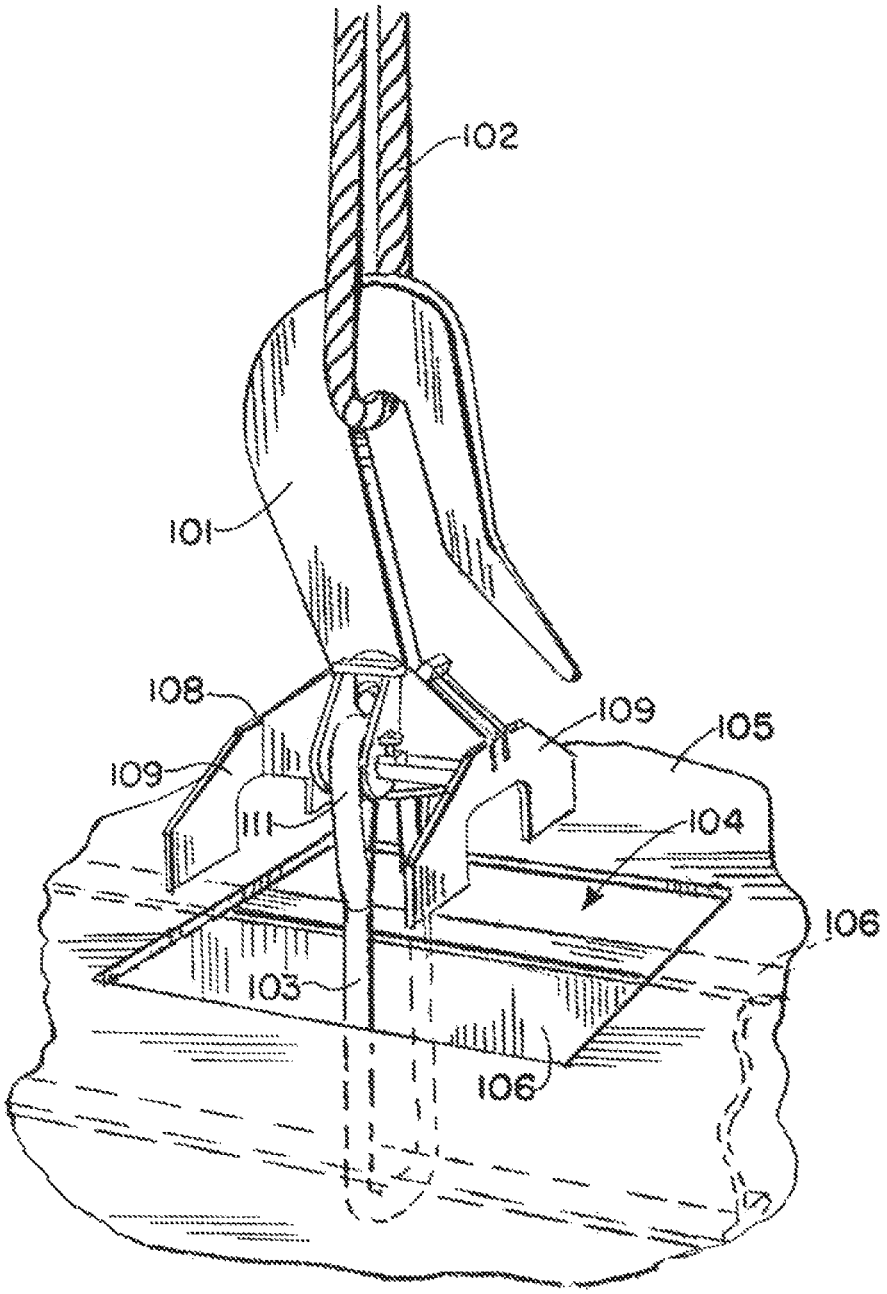
FIG. 23 is a partial, perspective view of the second embodiment of the apparatus of the present invention.
Figure 24:
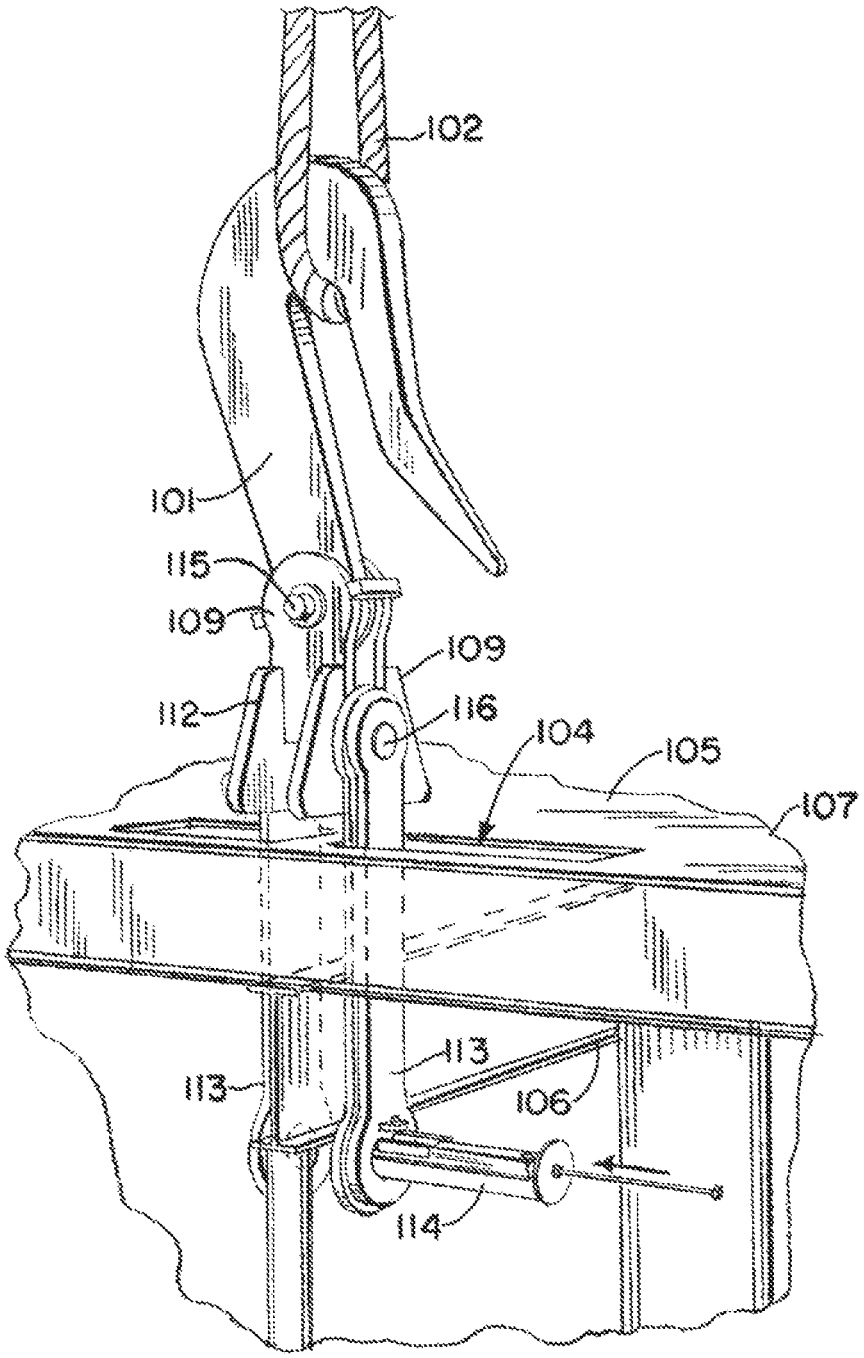
FIG. 24 is a partial, perspective view of the second embodiment of the apparatus of the present invention.

In order to ensure that the hooks 101 do not fall through the openings 104, each hook 101 is provided with a base structure 108 that can be fabricated of a plurality of plates 109 that are welded together and shafts 110 spanning between adjacent plates 109. Shafts 110 are receptive of the loops 111 of the slings 103 as shown in FIGS. 22-23. Examples of hook and base structure arrangements are seen in FIGS. 22 and 23. In FIG. 24, a base structure 112 employs a plurality of links 113 that extend through an opening 104 (e.g. cut opening) in deck 105 and wherein a pinned connection 114 extends through the links 113 and beneath an underdeck beam 106 as shown. Hook 101 of FIG. 24 can attach via pinned connections 115, 116 and plates 109 to the links 113.

The following is a list of parts and materials suitable for use in the present invention.

PARTS LIST

| Part Number | Description |
|---|---|
| 10 | marine lifting apparatus |
| 11 | vessel |
| 12 | vessel |
| 13 | first frame or truss |
| 14 | second frame or truss |
| 15 | universal joint |
| 16 | hinge |
| 17 | universal joint |
| 18 | hinge |
| 19 | load spreader platform interface |
| 20 | load spreader platform interface |
| 21 | area |
| 22 | dimension line |
| 23 | dimension line |
| 24 | water surface |
| 25 | clearance above water |
| 26 | clearance above hull deck |
| 27 | center truss section |
| 28 | smaller truss section |
| 29 | smaller truss section |
| 30 | hull deck |
| 31 | pinned connection |
| 32 | pinned connection |
| 33 | sunken vessel |
| 34 | damaged platform section |
| 35 | maximum deck elevation |
| 36 | load spreader platform |
| 37 | load spreader platform |
| 38 | longitudinal beam |
| 39 | transverse beam |
| 40 | lifting hook |
| 41 | lifting line |
| 42 | winch |
| 43 | sheave |
| 44 | sheave |
| 45 | sheave |
| 46 | transport vessel |
| 47 | arrow |
| 48 | upper sheave |
| 49 | upper pulley block |
| 50 | lower pulley block |
| 51 | sling |
| 52 | beam |
| 53 | sling |
| 54 | spreader bar |
| 55 | seabed |
| 56 | arrow |
| 57 | arrow |
| 58 | arrow |
| 59 | arrow |
| 60 | grab |
| 61 | padeye |
| 62 | padeye |
| 63 | first shaft |
| 64 | second shaft |
| 65 | arrow |
| 66 | arrow |
| 67 | anchor line |
| 68 | anchor winch |
| 69 | opening |
| 70 | marine lifting apparatus |
| 71 | vessel |
| 72 | vessel |
| 73 | frame |
| 74 | frame |
| 75 | universal joint |
| 76 | hinge |
| 77 | universal joint |
| 78 | hinge |
| 79 | load spreader platform interface |
| 80 | load spreader platform interface |
| 81 | area |
| 82 | dimension line |
| 83 | water surface area |
| 84 | clearance above water |
| 85 | clearance above hull deck |
| 86 | hull deck |

-continued

| PARTS LIST | |
|---|---|
| Part Number | Description |
| 87 | hull deck |
| 88 | winch |
| 89 | winch |
| 90 | winch |
| 91 | winch |
| 92 | winch line |
| 93 | winch line |
| 94 | winch line |
| 95 | winch line |
| 96 | beam |
| 97 | beam |
| 98 | crown block |
| 99 | crown block |
| 100 | frame/spreader |
| 101 | hook |
| 102 | sling |
| 103 | sling |
| 104 | opening |
| 105 | deck |
| 106 | underdeck beam |
| 107 | platform |
| 108 | base structure |
| 109 | plates |
| 110 | shaft |
| 111 | loop |
| 112 | base structure |
| 113 | link |
| 114 | pinned connection |
| 115 | pinned connection |
| 116 | pinned connection |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of salvaging an underwater object from a seabed area comprising the steps of:

a) providing first and second spaced apart hulls at a locale that is next to an underwater object to be salvaged;

b) spanning a first arch between the hulls;

c) spanning a second arch between the hulls;

d) spacing the arches apart by connecting the hulls together in a configuration that spaces the hulls apart;

e) connecting the first arch to the first hull with a universal joint and connecting the first arch to the second hull with a pinned connection;

f) connecting the second arch to the second hull with a universal joint and connecting the second arch to the first hull with a pinned connection;

g) extending each arch upwardly in an inverted u-shape, providing a space under the arches and in between the hulls;

h) lifting the object to be salvaged from the seabed area with rigging fitted to the arches; and i) wherein winches on the hulls fitted with anchor lines position the hulls.

2. The method of claim 1 wherein each arch supports one or more beams and in step "h" the rigging includes the beams.

3. The method of claim 1 wherein the rigging includes a pair of beams.

4. The method of claim 1 wherein the first arch is a truss.

5. The method of claim 1 wherein the second arch is a truss.

6. The method of claim 1 wherein the underwater object is a platform having a deck and further comprising one or more slings that connect between the rigging and the platform.

7. The method of claim 6 further comprising the step of providing a hook as part of the rigging.

8. The method of claim 7 wherein the sling spans between the hook and the platform and the sling extending through the deck.

9. The method of claim 1 wherein the first arch is much wider at one end portion than at its other end portion.

10. The method of claim 1 wherein the second arch is much wider at one end portion than at its other end portion.

11. The method of claim 1 wherein the underwater object is a platform having a deck and wherein the rigging in step "h" includes a lifting winch mounted on a said deck and a winch cable rigged to the winch and to a said arch.

12. The method of claim 1 wherein the rigging in step "h" includes a lifting winch mounted on a said arch and a winch cable rigged to the winch and to a said arch.

13. A method of raising a submerged object from a seabed area in a marine locale comprising the steps of:

a) transporting a floating support structure to the marine locale, wherein the floating structure includes spaced apart first and second deck areas with an open space between the deck areas;

b) connecting first and second spaced apart arches to the floating support structure with connections that include first and second universal joints and first and second pinned connections;

c) wherein step "b" the first arch is connected to the first deck area with the first universal joint and the first arch is connected to the second deck area with the first pinned connection;

d) wherein in step "b" the second arch is connected to the first deck area with the second pinned connection and the second arch is connected to the second deck area with the second universal joint;

e) lifting the submerged object from the seabed area with rigging that is supported by the combination of floating support structure and arches;

f) wherein the object lifted in step "e" is lifted to the open space of step "a"; and g) positioning the floating support structure with winches on the support structure fitted with anchor lines.

14. The method of claim 13 wherein in step "a" the floating support structure includes a catamaran.

15. The method of claim 4 wherein step "b" is completed before step "a".

16. The method of claim 13 wherein step "a" includes using multiple hulls to transport the floating support structure, said hulls being a part of the support structure.

17. The method of claim 16 wherein step "b" is completed before step "a".

18. The method of claim 13 wherein step "a" includes using multiple vessels to transport the floating support structure, said vessels being a part of the support structure.

19. The method of claim 13 wherein each arch has a wide end portion and a narrow end portion, and further comprising the step of connecting the narrow end of each arch to the floating support structure with a universal joint of step "b".

20. The method of claim 19 wherein each arch has a wide end portion and a narrow end portion, and further comprising the step of connecting the wide end of each arch to the floating support structure with a hinge of step "e".

21. The method of claim 13 wherein each arch has a wide end portion and a narrow end portion, and further comprising the step of connecting the wide end of each arch to the floating support structure with a hinge of step "e".

22. The method of claim 13 wherein in step "a" the floating structure is a catamaran and further comprising step "b" being completed before the completion of step "a".

23. The method of claim 13 wherein step "b" is completed before step "a".

24. The method of claim 13 wherein the rigging in step "c" includes one or more beams that span between the arches and further comprising suspending a crown block from the beam or beams.

25. The method of claim 13 wherein the rigging in step "e" includes a lifting winch mounted on a said deck area and a winch cable rigged to the winch and to a said arch.

26. The method of claim 13 wherein the rigging in step "e" includes a lifting winch mounted on a said arch and a winch cable rigged to the winch and to a said arch.

* * * * *